US009341435B1

(12) United States Patent
Mansfield

(10) Patent No.: US 9,341,435 B1
(45) Date of Patent: May 17, 2016

(54) ELECTROMAGNETIC LAUNCHER

(71) Applicant: JTI Innovations, LLC, Arlington, VA (US)

(72) Inventor: Francis Allen Mansfield, Arlington, VA (US)

(73) Assignee: JTI Innovations, LLC, Arlington, VA (US)

( * ) Notice: Subject to any disclaimer, the term of this patent is extended or adjusted under 35 U.S.C. 154(b) by 0 days.

(21) Appl. No.: 14/458,581

(22) Filed: Aug. 13, 2014

(51) Int. Cl.
*F41B 6/00* (2006.01)

(52) U.S. Cl.
CPC ..... *F41B 6/003* (2013.01)

(58) Field of Classification Search
CPC ..... F41B 6/00; F41B 6/003; F41B 6/006; F42B 6/006
USPC ..... 124/3
See application file for complete search history.

(56) References Cited

U.S. PATENT DOCUMENTS 2,235,201 A * 3/1941 Cole ..... 124/3
3,602,745 A * 8/1971 Davis ..... H02K 41/025 310/13
3,679,952 A * 7/1972 Pelenc ..... 318/135
3,919,607 A * 11/1975 Habock et al. ..... 318/135
4,319,168 A * 3/1982 Kemeny ..... 318/135
4,760,294 A * 7/1988 Hansen ..... H01F 5/003 310/13
4,858,511 A * 8/1989 Jasper, Jr. ..... 89/8
4,901,621 A * 2/1990 Tidman ..... 505/164
4,913,030 A * 4/1990 Reynolds ..... 89/8
4,926,741 A * 5/1990 Zabar ..... F41B 6/00 124/3
4,960,760 A * 10/1990 Wang et al. ..... 505/164
5,155,289 A * 10/1992 Bowles ..... 89/8
5,168,118 A * 12/1992 Schroeder ..... 89/8
5,173,568 A * 12/1992 Parmer ..... 89/8
5,217,948 A * 6/1993 Leung et al. ..... 124/3
5,431,083 A * 7/1995 Vassioukevitch ..... 89/8
5,483,863 A * 1/1996 Dreizin ..... 89/8
7,111,619 B2 * 9/2006 Schneider ..... F41B 6/003 124/8
7,271,509 B2 * 9/2007 Hoppe ..... H02K 41/03 310/12.16
7,444,919 B1 * 11/2008 Mansfield ..... 89/8
7,946,209 B2 * 5/2011 Schneider et al. ..... 89/8
8,076,804 B2 * 12/2011 Jajtic ..... H02K 41/031 310/12.01
8,302,584 B1 * 11/2012 Lu ..... 124/3
8,746,120 B1 * 6/2014 Nolting et al. ..... 89/8
9,062,949 B1 * 6/2015 Clemen et al.
2005/0023054 A1 * 2/2005 Weidenheimer et al. .... 180/65.2
2005/0155487 A1 * 7/2005 Frasca ..... 89/8
2005/0280316 A1 * 12/2005 Nozawa ..... H02K 41/03 310/12.22
2008/0006144 A1 * 1/2008 Gaigler et al. ..... 89/8
2008/0012680 A1 * 1/2008 Muelleman ..... 336/212
2009/0302982 A1 * 12/2009 Putman et al. ..... 335/216
2009/0322162 A1 * 12/2009 Jajtic ..... H02K 41/031 310/12.24
2010/0263648 A1 * 10/2010 Basak et al. ..... 124/3
2010/0300274 A1 * 12/2010 Root, Jr. ..... 89/1.814
2014/0060508 A1 * 3/2014 Floyd et al. ..... 124/3

* cited by examiner

*Primary Examiner* — Bret Hayes
*Assistant Examiner* — Derrick Morgan
(74) *Attorney, Agent, or Firm* — Knobbe Martens Olson & Bear LLP

(57) ABSTRACT

An electromagnetic (EM) launcher can include multiple conductive coils wrapped around a launch conduit. The EM launcher can also include a multi-phase, variable frequency linear induction motor drive. The EM launcher can be used to launch a payload under controlled acceleration at a desired velocity.

23 Claims, 4 Drawing Sheets

ELECTROMAGNETIC LAUNCHER

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Conventional electromagnetic (EM) launchers, such as railguns, employ two or more conducting rails within a breech and/or along the barrel to accelerate an armature that pushes a projectile for launch. Railguns exhibit deficiencies with rail life, energy storage, and transfer, thermal management, and sabot design. Coilguns also exhibit a number of deficiencies including the amount of power required to accelerate the projectile to an acceptable rate.

DETAILED DESCRIPTION

As described herein, an electromagnetic (EM) launcher can receive multi-phase alternating current (AC) electrical power to launch a payload under controlled acceleration at a desired velocity. The acceleration and exit velocity can be controlled via a controller to allow for a velocity and acceleration profile as desired. As such, the launcher can be configured to produce tens of thousands of pounds of force, depending on the system design, and can be configured to launch armatures weighing from hundreds or thousands of kilograms (or more) to one kilogram (or less), as desired. Furthermore, the EM launcher can be used to launch warheads, inert or non-inert materials, water, nuclear waste, etc. In some instances, the EM launcher can be used for transportation purposes, such as to launch shuttles into space, mass transit, etc.

In non-limiting embodiment, the EM launcher can include a concentric multi-phase tubular linear induction motor drive (TLIM) launcher, payload package with an attached armature, energy stores, multi-phase inverter, and a controller. In some embodiments, the armature/payload can be levitated within the conduit due to the concentric cross-sectional nature of the TLIM. In certain embodiments, the TLIM can be configured such that there is little to no contact between moving parts and thus little to no launch conduit wear. Furthermore, in certain embodiments of the launcher, there is no sabot, no physical contact between the payload and the launch conduit 102, no muzzle electrical arc, no explosive discharge, and/or no pulsing acceleration force. Any combination of the above-mentioned embodiments can be used as desired.

Figure 1:
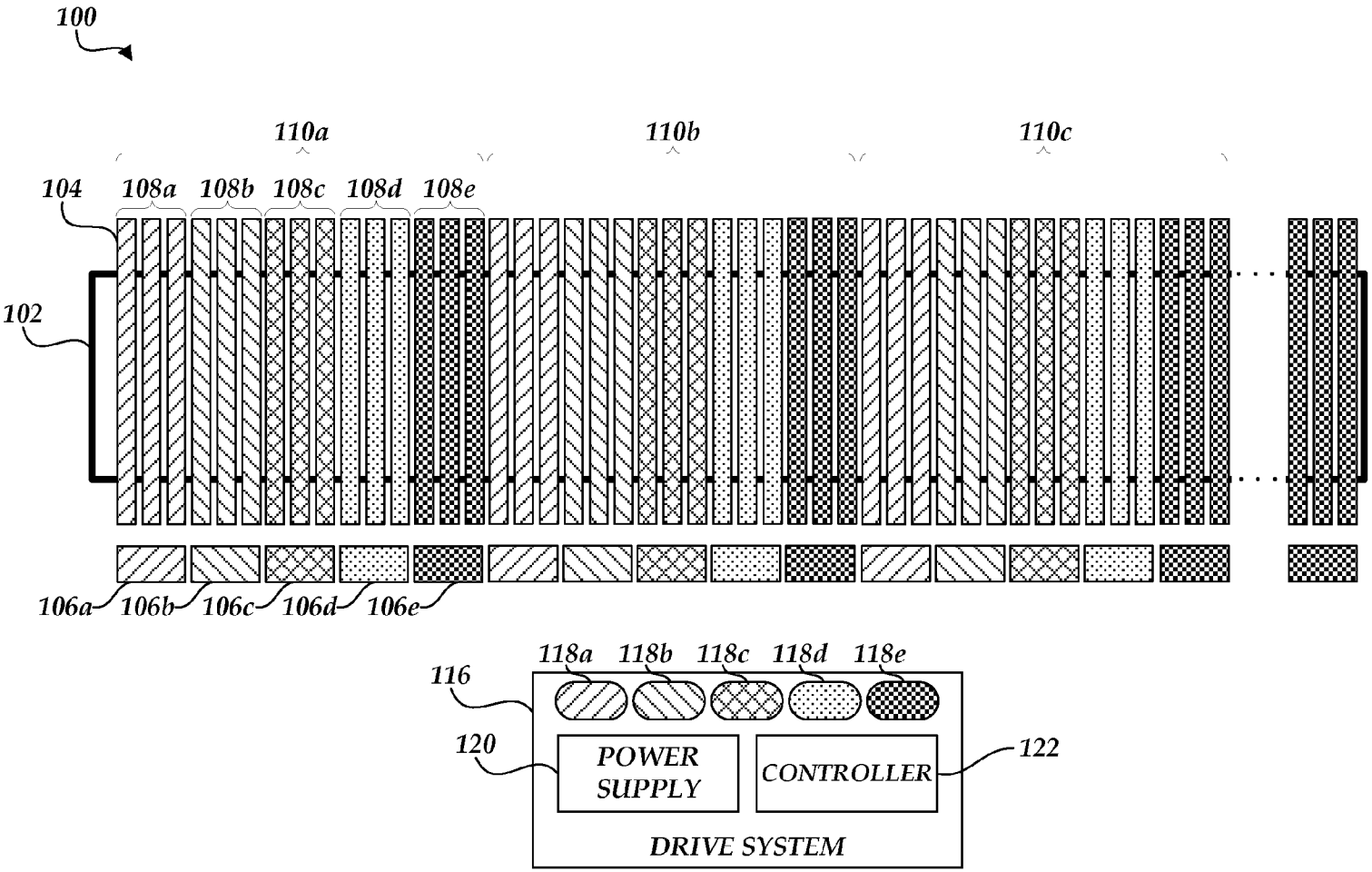
FIG. 1 is a drawing of an embodiment of an electromagnetic launcher.

FIG. 1 is a drawing of an embodiment of an EM launcher 100. In the illustrated embodiment, the EM launcher 100 includes a launch conduit 102, coils 104, switches 106, and a drive system 116 including current outputs 118, a power supply 120, and a controller 122. Although not illustrated in FIG. 1, the EM launcher 100 can further include a payload package 112 and an armature 114 (FIG. 2), and the drive system 116 can include one or more inverters coupled to the current outputs and the power supply 120.

The launch conduit 102 can be made of a non-conductive material and can be any length or width (or diameter) as desired. The length and width can depend on the size and mass of the projectile, the desired acceleration profile of the projectile, and/or the desired exit velocity of the projectile. For example, the launch conduit 102 can be longer for heavier projectiles and/or to achieve high exit velocities. In addition, a longer launch conduit 102 can be used to reduce the acceleration rate of the projectile, while still achieving a desired exit velocity. For example, a longer launch conduit can be used when humans are being launched in order to avoid excessive G-forces.

The cross-sectional shape of the launch conduit 102 can be any closed form shape (circular, elliptical, square, etc.). This allows launchers to be built to accommodate payloads with control surfaces for flight stability if the payload will not be spin-stabilized after launch. In some embodiments, the launch conduit 102 can be a tubular launch conduit.

The coils 104 can be distributed along the launch conduit 102. In the illustrated embodiment, the coils 104 are evenly spaced along the launch conduit 102. However, it will be understood that the coils 104 can be spaced as desired. The distance between each coil 104 can depend on the length of the launch conduit 102 and/or the desired exit velocity. For example, the longer the launch conduit 102, the larger the space between the coils 104 can be. As will be described in greater detail below with reference to FIG. 4, each coil 104 can include one or more conductive wires. The wires of each coil 104 can be electrically coupled in parallel or in series to each other and can be made of any number of conductive materials, such as, but not limited to magnet copper wire, a copper-silver alloy, etc. In some embodiments, each coil 104 can be placed over a unique portion of the launch conduit 102 without overlapping each other. In certain embodiments, the coils can be wound to overlap each other.

In the illustrated embodiment, the width of all the coils 104 on the launcher 100 can be the same or approximately (e.g., ±5-15%) the same. However, it will be understood that the width of the coils 104 can vary as desired. In certain embodiments, the height of the coils 104 can vary across the length of the conduit 102. In some embodiments the height of the coils 104 (as measured from the launch conduit 102 to the last turn of the coil) can be the same or approximately (e.g., ±5-15%) the same along the launch conduit 102. In certain embodiments, the height of the coils 104 (as measured from the launch conduit 102 to the last turn of the coil) gradually decreases from the one end of the launch conduit 102 to the exit of the launch conduit 102.

The coils 104 can be organized into different coil groups 108*a*, 108*b*, 108*c*, 108*d*, 108*e* (generically referred to as coil group(s) 108). Each coil group can be associated with a different phase of the drive system (or different current outputs 118 described in greater detail below). In the illustrated embodiment of FIGS. 1 and 2, each coil group 108 includes three consecutive coils 104. However, it will be understood that that each coil group 108 can include fewer or more coils 104, as desired. In some embodiments, the coils 104 of each coil group 108 can be electrically coupled in parallel or series to each other. In some embodiments, increasing the number of coils per coil group can increase the power density of each coil group or phase and/or reduce losses due to harmonics.

One or more coil groups 108 can be organized into different poles 110*a*, 110*b*, 110*c* (generically referred to as pole(s) 110). In the illustrated embodiment of FIGS. 1 and 2, the launcher 100 includes at least three poles 110*a*, 110*b*, 110*c* and each pole 110 includes five consecutive coil groups 108*a*, 108*b*, 108*c*, 108*d*, 108*e*. However, it will be understood that the number of poles 110 in the launcher 100, and the number of coil groups 108 per pole 110 can vary as desired. For example, in some embodiments, the launcher 100 can include one, three, five, or seven coil groups or phases per pole, etc.

By increasing the number of coil groups or phases per pole, the amount of required power per phase can be reduced, as well as the power demands on the switches 106 and/or inverters in the drive system 116. For example, in some instances, the power demands on the switches 106 and/or the inverters in a launcher 100 with three coil groups 108 per pole 110 can be 2.5 times greater than the power demands on a switch 106/inverter in a similarly configured launcher 100 with five coil groups 108 per pole 110. Accordingly, switches 106/inverters with lower power ratings can be used in a five-phase launcher 100 than in a three-phase launcher 100. In addition, in some embodiments, the armature length can be increased as more coil groups or phases per pole are used.

In some embodiments, the number of poles 110 on the launcher 100 can depend on the desired acceleration profile, the desired velocity profile and/or the power ratings of the switches 106/inverters. For example, more poles, which can correspond to a longer conduit 102, can be used when a slower acceleration profile is desired, a higher mass or larger diameter armature 114 is desired (described in greater detail below with reference to FIG. 2), a higher exit velocity is desired, and/or lower power demands on the switches 106/inverters is desired.

With continued reference to FIG. 1, the switches 106*a*, 106*b*, 106*c*, 106*d*, 106*e* (generically referred to as switch(es) 106) can be used to supply current/power to the different coils 104 of the coil groups 108, increase the efficiency of the launcher 100, and/or reduce the power demands on the drive system 116. The switches 106 can be implemented using a variety of components, including, but not limited to, thyristors, silicone rectifiers (SCRs), insulated-gate bipolar transistors (IGBTs), high-frequency switches, rectifiers, etc. In some embodiments, the switches 106 can be liquid-cooled for very high megawatt pulse output and/or repetitive firing in a relatively short amount of time.

In the illustrated embodiment, each coil group 108 includes a corresponding switch 106*a*, 106*b*, 106*c*, 106*d*, 106*e*. However, the ratio to switches and coil groups can vary as desired. For example, each switch 106 can be coupled to a coil group 108 in multiple poles. In some embodiments, the switch 106*a* can be coupled to the first coil group 108*a* of multiple poles 110 (or each pole 110) of the launcher 100, the second switch 106*b* can be coupled to the second coil group 108*b* of multiple poles 110 (or each pole 110) of the launcher 100, etc. In this manner, the number of switches 106 can be reduced. However, in some embodiments, fewer switches 106 in the launcher 100 can result in increased power consumption and/or increased power demands on the switches 106 and/or the drive system 116.

In some embodiments, the switches 106 can be omitted from the launcher 100. For example, in embodiments having a relatively short launch conduit 102 (e.g., 2-3 meters), fewer power constraints, and/or when a relatively few number of poles 110 (e.g., 5-8) are used, the switches 106 can be omitted. However, it will be understood that the switches 106 can be omitted as desired, but can result in increased power consumption and increased power demands on the drive system 116.

The drive system 116 can supply an alternating current to the switches 106 and/or coil groups 108 and can be used to control the acceleration profile and exit velocity of the payload package 112 (described in greater detail below with reference to FIG. 2). In the illustrated embodiment, the drive system 116 includes a multi-phase, variable frequency AC power drive to supply alternating current to the switches 106 and/or coil groups 108. However, it will be understood that the drive system 116 can be implemented in a variety of ways as desired. For example, the drive system 116 can include a single phase power drive to supply current at a single phase, a multi-phase power drive to supply multi-phase current (e.g., three-phase current, five-phase current, seven-phase current, etc.), a fixed frequency power drive to supply current at an approximately fixed frequency, and/or a variable frequency power drive to supply current at various frequencies, as desired. The variable frequency power drive can be implemented as an AC-AC power drive, and/or a DC-AC power drives as desired. In some embodiments, the drive system 116 can be implemented as a multi-phase linear induction motor drive.

In the illustrated embodiment, the drive system 116 includes current outputs 118*a*, 118*b*, 118*c*, 118*d*, 118*e* (generically referred to as current output(s) 118), a power supply 120, and a controller 122. However, it will be understood that the drive system 116 can include fewer or more components as desired. For example, the drive system 116 can include fewer or more current outputs 118 depending on the number of coil groups 108 per pole 110, the number of phases output by the drive system 116, etc.

The power supply 120 in the illustrated embodiment is a DC power supply. However, it will be understood that the power supply 120 can be implemented as an AC power supply. When implemented as a DC power supply, the power supply 120 can be implemented using a bank of capacitors, one or more batteries, or other DC energy sources, etc.

As mentioned previously, although not illustrated in FIG. 1, the drive system 116 can include one or more inverters to produce the phases of the drive system when the power supply 120 is a DC power supply 120. The different phases can be coupled with the current outputs 118. Each inverter can be coupled to an individual power supply 120, or a common power supply 120 can be shared between two or more inverters. However, it will be understood that in some embodiments, the inverters can be omitted, such as when the power supply 120 is an AC power supply, etc.

The inverters can be implemented as full-bridge inverters or half-bridge inverters, etc., using one or more switches (similar to the switches 106 described above). However, it will be understood that the inverters can be implemented using a variety of topologies as desired.

The inverters can convert direct current from the power supply 120 to AC current at one or more phases, which can be coupled to the current outputs 118 for use by the coil groups 108. Although not illustrated in FIG. 1, in some embodiments, the drive system 116 can include an additional power supply that produces AC power and one or more converters that converts the AC power to DC power. The converted DC power can be stored in the power supply 120.

In embodiments in which multiple phases are used, such as the illustrated embodiment, the drive system 116 can include multiple single-phase inverters and/or a multi-phase inverter to supply multi-phase current to the coil groups 108 via the current outputs 118. In some embodiments, the drive system 116 can provide a separate phase for each coil group 108 via the current output 118. For example, in embodiments in which there are three coil groups 108*a*, 108*b*, 108*c*, the drive system 116 can provide three-phase current to the coil groups 108*a*, 108*b*, 108*c* using the current outputs 118*a*, 118*b*, 118*c*. Similarly, in the illustrated embodiment in which there are five coil groups 108*a*, 108*b*, 108*c*, 108*d*, 108*e*, the drive system 116 can provide five-phase current to the coil groups 108*a*, 108*b*, 108*c*, 108*d*, 108*e* using current outputs 118*a*, 118*b*, 118*c*, 118*d*, 118*e*, etc. It will be understood that the drive system 116 can be configured to have as many phases and/or current outputs 118 as desired. As mentioned previously, an increased number of phases can result in reduced power demands on the switches 106 and/or the inverters.

In certain embodiments, a phase from the drive system 116 can be coupled to a particular coil group 108 (or corresponding switch) of each pole 110 of the launcher 100 via the current output 118. For example, in some embodiments, the current output 118*a* (or corresponding inverter), which corresponds to a particular phase of the drive system 116, can be coupled to the first coil group 108*a* (or corresponding switch 106*a*) of multiple poles 110 (or each pole 110) of the launcher 100, a second current output 118*b* (or corresponding inverter), which corresponds to a second phase of the drive system 116, can be coupled to the second coil group 108*b* (or corresponding switch 106*b*) of multiple poles 110 (or each pole 110) of the launcher 100, etc. In this manner, each coil group 108 can receive a distinct current phase from a multi-phase current drive system 116.

In certain embodiments, the switches 106 can improve the efficiency of the launcher 100 and can be used to reduce the power demands on the inverters in the drive system 116. For example, the switches 106 can be used to activate certain coil groups 108 and/or poles 110, while leaving other coil groups 108 and/or poles 110 inactive (e.g., not drawing substantial amounts of current from the driver system 116). For example, at the beginning of a launch, all coil groups 108 in the first two poles 110*a*, 110*b* can be activated using the switches 106, while the coil groups 108 in the third pole 110*c* can be left inactive. As the payload package 112 moves away from the first coil groups (e.g., coil groups 108*a*, 108*b*) of the pole 110*a*, the first coil groups 108 of the pole 110*a* can be deactivated and the coil groups 108*a*, 108*b* of the third pole 110*c* can be activated. In this manner, the power demands on the inverters can be reduced from having to supply power to all the coil groups 108 of all the poles 110 of the launcher 100 simultaneously to supplying power to a subset of the coil groups 108/poles 110 of the launcher 100.

The controller 122 can be implemented using a microprocessor, microcontroller, programmable logic device (PLD), field programmable gate array (FPGA), etc. and can be used to control the acceleration profile and exit velocity of the payload package 112, as well as conserve power. Additionally, the controller 122 can allow for continual adjustment of the current and frequency of the current outputs 118 to accommodate for fluctuations in acceleration and velocity gain as the armature 114 and payload package 112 (described in greater detail below with reference to FIG. 2) travel down the launch conduit 102. This control can also accommodate varying payload sizes for the same launcher 100. Furthermore, the controller 122 can control the current profile and associated frequency of each inverter (or current output 118) for each phase.

In some embodiments, the controller 122 can control the acceleration profile and exit velocity by controlling the inverters and/or switches 106. For example, the controller 122 can control the frequency of the phases of the drive system 116 and the current outputs 118, as well as the amount of power provided by the drive system 116. In certain embodiments, the controller 122 can vary the frequency of the phases of the drive system 116 (and the current outputs 118) via the inverters. For example, as the velocity of the payload package 112 increases as it moves through the conduit 102, the controller 122 can increase the frequency of the phase(s) or current output(s) 118. The increased frequency of the phases (and the current outputs 118) can further accelerate the payload package 112.

Similarly, the controller can conserve power and/or reduce the power demands on the drive system 116 by controlling the switches 106. For example, the controller 122 can activate/deactivate different coil groups 108 (using the switches 106) as the payload package 112 moves through the launch conduit 102. As described previously, in so doing, the controller 122 can reduce the power demands on the inverters/drive system 116.

Figure 2:
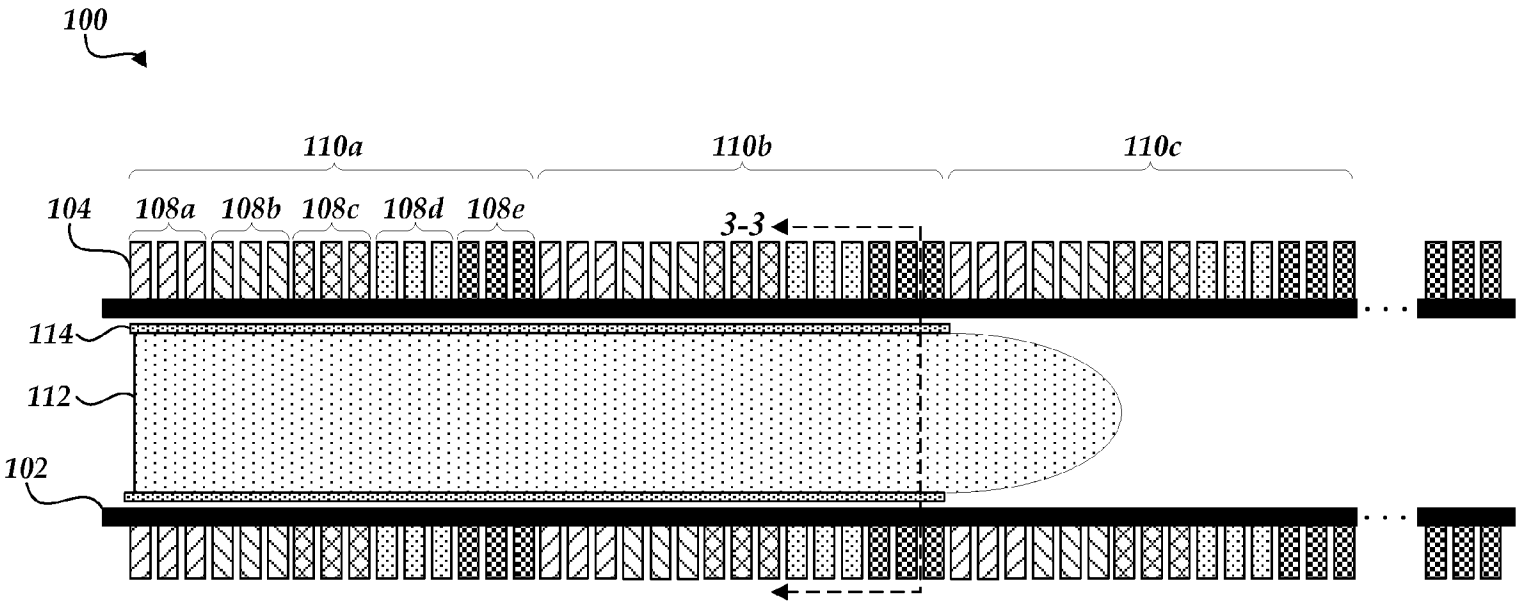
FIG. 2 is a lengthwise cross-sectional view of an embodiment of the electromagnetic launcher.

FIG. 2 is a lengthwise, cross-sectional view of an embodiment of the electromagnetic launcher. In addition to the conduit 102, coils 104, switches 106, coil groups 108, and poles 110, described previously, FIG. 2 further illustrates an embodiment of the payload package 112 and the armature 114 mentioned previously.

The payload package 112 can be solid or can be hollow and can include an internal payload. The internal payload can include any desired material, such as, but not limited to inert or non-inert materials, a bullet, a warhead, chemicals, nuclear waste, water, a vehicle for transportation purposes, etc. In some embodiments, the payload package 112 can be thermally isolated from the internal payload using a thermal insulator.

The payload package 112 can be made of material that can withstand the launch environment and heat that occurs during launch, such as, but not limited to ceramic, iridium, frozen water, a metal-ceramic composite, etc., and shaped as desired. In the illustrated embodiment, the payload package 112 is shaped like a gun shell. However, it will be understood that a variety of shapes can be used for the payload as desired. In some embodiments, the payload can have an aerodynamic shape in order to increase its range, etc. In some embodiments, the center of gravity of the payload package 112 can be located somewhere on the armature 114 to keep the payload package 112 centered during the launch sequence.

The armature 114 can be made of conductive material(s) and shaped to complement the shape of the payload package 112. In some embodiments, the conductive material can be thicker than a first thickness threshold to reduce skin effect and thinner than a second thickness threshold to withstand the induced current. In the illustrated embodiment, the armature 114 is coupled to the payload package 112 to form part of the payload package 112. Accordingly, in some embodiments, the armature remains attached or affixed to the payload package 112 after exiting the conduit 102. In this manner, the amount of debris from the launcher 100 can reduced and/or eliminated. However, it will be understood that a sabot can be used for the armature 114 as well.

In some embodiments, the armature 114 can be thermally connected and electrically isolated from the payload package 112. In this manner, the armature 114 can transfer heat to the payload package 112. For example, a thermally conductive, electrical insulating material (not shown), such as but not limited to, an epoxy, ceramic, laminate, adhesive, tape, etc. can be used to thermally couple and electrically isolate the armature 114 to the payload package 112. However, it will be understood that the armature 114 can be thermally isolated from the payload package 112 as desired.

In the illustrated embodiment, the length of the armature is equal or approximately equal (e.g., ±5-15%) to two pole lengths. In this manner, the armature 114 can remain levitated during launch. However, it will be understood that the length of the armature 114 can be any multiple of the pole length as desired. In some embodiments, a longer pole length can decrease the amount of current required per unit of acceleration. For example, in some embodiments, increasing armature 114 length from two pole lengths to three pole lengths can reduce the amount of current per unit of acceleration by 10-20%.

As mentioned previously, the launcher system can also include a controller 122 that controls one or more inverters that form part of a multiphase (e.g., 5-phase, 7-phase, etc.) drive system 116 and the switches 106 that activate and deactivate the coils 104 as the armature 114 moves down the launch conduit 102. The switches 106 can improve the efficiency of the launcher 100 and can be used to reduce the size and/or power demands on the inverters. The controller 122 can allow for continual adjustment of the current and frequency of the individual inverter outputs to accommodate for fluctuations in acceleration and velocity gain as the armature 114 and payload package 112 travel down the launch conduit 102. This control can also accommodate varying payload sizes for the same launcher 100.

With reference to FIGS. 1 and 2, during a launch, the controller 122 can activate the switches 106 that correspond to the coil groups 108 where the armature 114 is located such that current is able to flow through the corresponding coils 104. The varying current flowing through the coils 104 can generate a magnetic field that generates a current in the armature 114, causing the armature to levitate. The magnetic field can also generate a force that accelerates the armature 114 (and payload package 112) along a longitudinal axis of the conduit and towards the exit of the conduit 102. As the armature 114 moves through the conduit 102, the controller 122 can activate different coil groups 108 to accelerate the payload package 112 towards the exit. The greater the current in the coils 104, the greater the force exerted on, and acceleration of, the armature 114. In addition, as mentioned previously, the controller 122 can cause the frequency of the phases or current outputs 118 to increase as the payload package 112 accelerates towards the exit.

During the launch, the force exerted on the armature 114 at any given time can be calculated as the sum of all the force produced by the magnetic fields of the coils 104 associated with the length of the armature 114 (e.g., the coils that are in plane, or substantially in plane, with the length of the armature 114). For example, with respect to the illustrated embodiment in which there are three coils 104 per coil group 108, five coil groups 108 per pole 110, and the armature 114 is two poles 110 long, the force at any given time can be calculated as the sum of the force produced by the 30 coils 104 (or whichever coils have current flowing through them. Accordingly, as the armature 114 moves through the launch conduit 102, the coils 104 that are in plane, or substantially in plane, with the length of the armature 114 can be activated. Thus, the force can be distributed over the circumference and length of the armature 114 thereby lowering the force per unit area on the armature 114.

In some embodiments, the force exerted on the armature 114 at any given time can include one or more coils 104 that are in front of or behind the armature 114 (e.g., closer to, or farther away from, the exit of the launch conduit 102). Thus, as the armature 114 moves through the launch conduit 102, the coils 104 that are in plane, or substantially in plane, with the length of the armature 114 can be activated as well as one or more coils 104 in front of or behind the armature 114. For example, the two or three coils 104 that are in front of the armature 114 and behind the armature 114 can be activated as well as the coils 104 associated with the length of the armature 114.

Furthermore, the total force exerted on the armature 114 throughout the entire launch sequence, or the total power or force put into the payload package 112, can be calculated as the sum of all the force produced by the magnetic fields of the coils 104 associated with the length of the launch conduit 102.

Figure 3:
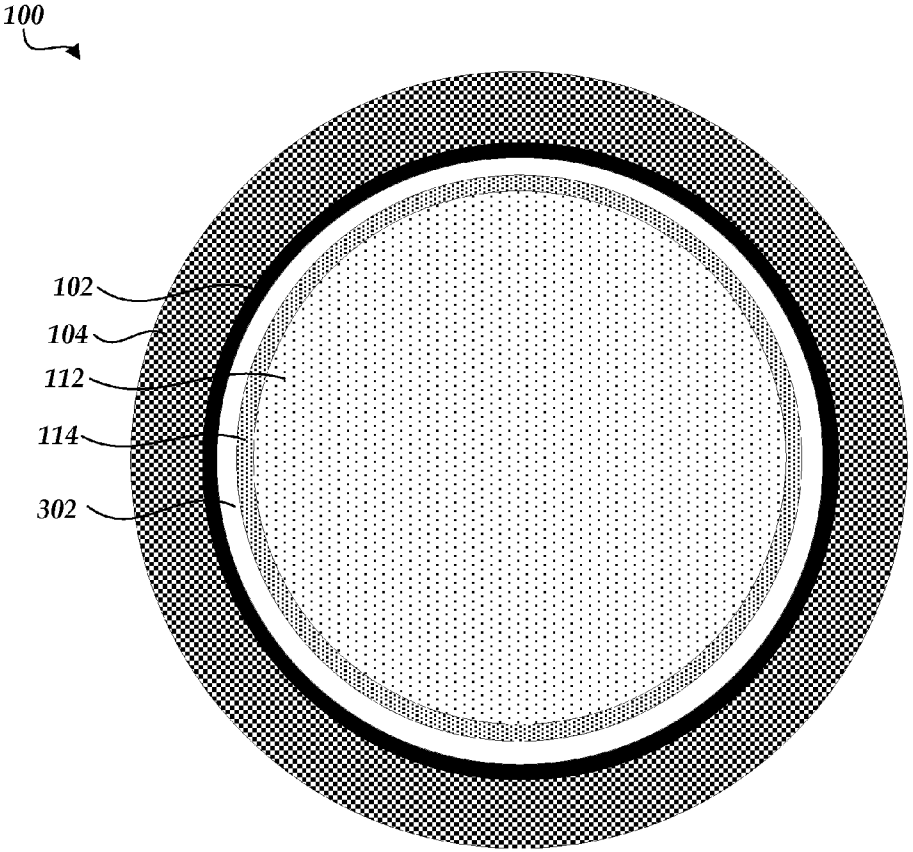
FIG. 3 is a cross-sectional view along the line 3-3 of an embodiment of the electromagnetic launcher.

FIG. 3 is a cross-sectional view along the line 3-3 of an embodiment of the electromagnetic launcher 100. In the illustrated embodiment of FIG. 3, the payload package 112 and armature 114 can be physically coupled together (and thermally coupled or uncoupled and electrically isolated) and can be separated from the conduit 102 and the coil 104 by an air gap 302. The air gap 302 can be generated by the magnetic field that is generated by current flowing through the coil 104. In this manner, the payload package 112 and armature 114 can be levitated as it travels through the conduit 102.

Figure 4B:
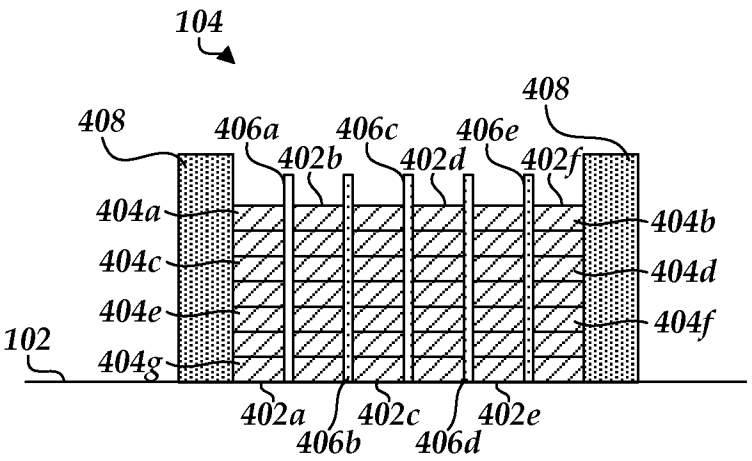
FIGS. 4A and 4B are cross-sectional views of embodiments of a coil.
Figure 4A:
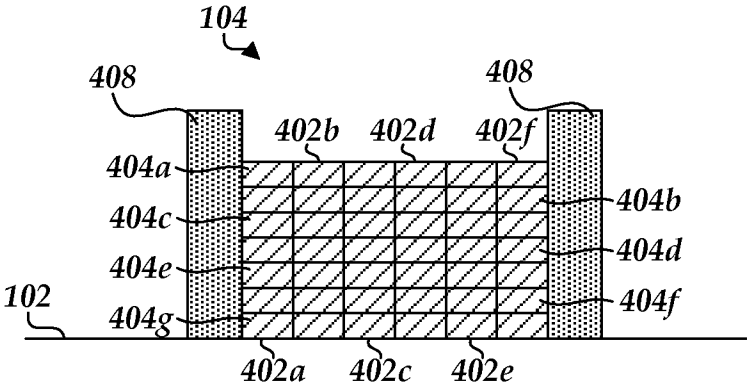

FIGS. 4A and 4B are cross-sectional views of embodiments of the coil 104 wrapped around the conduit 102. In the illustrated embodiment of FIG. 4A, the coil 104 is formed from the wires 402*a*, 402*b*, 402*c*, 402*d*, 402*e*, 402*f* (generically referred to as wire 402) wound as a unified current sheet. In the illustrated embodiment of FIG. 4B, the coil 104 is formed from the wires 402*a*, 402*b*, 402*c*, 402*d*, 402*e*, 402*f* with coil spacers 406*a*, 406*b*, 406*c*, 406*d*, 406*e* (generically referred to as coil spacer 406) placed between the single wires 402, or from the wires 402*a*, 402*b*, 402*c*, 402*d*, 402*e*, 402*f* that are insulated from each other. In both illustrated embodiments, a coil separator 408 is located on either side of the coil 104.

In some embodiments, the wires 402*a*, 402*b*, 402*c*, 402*d*, 402*e*, 402*f* can be configured as a 1×6 wire ribbon, similar to the embodiment illustrated in FIG. 4A. Depending on the design and to account for current load, wire ribbons can be thicker and wider, so instead of a 1×6 ribbon, the wire ribbon could be 2×6, 3×6, or any combinations of number wires thick and wide.

Although in the illustrated embodiments each coil 104 includes six wires 402*a*, 402*b*, 402*c*, 402*d*, 402*e*, 402*f*, it will be understood that fewer or more wires 402 can be used as desired. Furthermore, in the illustrated embodiments, each wire 402 is wrapped around the conduit 102 seven times, or has seven turns 404*a*, 404*b*, 404*c*, 404*d*, 404*e*, 404*f*, 404*g* (generically referred to as a turn 404). However, it will be understood that any number of turns 404 can be used as desired. Furthermore, the number of turns 404 per wire 402 can vary along the length of the conduit 102.

The wires 402 can be wrapped directly around the conduit 102 or can be wrapped around a circular-shaped object (or whatever shape complements the conduit 102) that can fit around the conduit 102 (e.g., the cross-sectional circumference/perimeter of the conduit 102). In some embodiments, the coil separators 408 can separate the different coils 104 and can keep the wires 402 in place. The coil separators 408 can be made of a non-conductive and/or non-magnetic material. In certain embodiments, the coil separators 408 can form part of a single coil separator that includes a valley between the illustrated coil separators 408. In such embodiments, the wires 402 can be wrapped around the valley portion of the coil separator 408. In some embodiments, the coil separator 408 can form part of the conduit 102, and in certain embodiments the coil separator 408 can be separate from, and coupled to, the conduit 102.

The individual wires 402 can be rectangular in shape with a width to height ratio between 1.25 and 2. However, it will be understood that other shapes and ratios can be used as desired. For example, the individual wires 402 can be elliptical, oval, square, trapezoidal, etc. In some embodiments, the width to height ratio of the wires 402 can vary along the length of the conduit 102. For example, in some instances, such as to account for the increased current as the armature accelerates towards the exit of the conduit 102, the thickness of the wires 402 closer to the exit of the launch conduit 102 can increase and the number of turns 404 per coil 104 can decrease. In embodiments where the height of the coils 104 along with length of the conduit 102 remains the same or approximately the same, the number of turns 404 of each wire 402 can decrease in accordance with the increased thickness such that the height of the coil 104 remains the same.

In the illustrated embodiment, the wires 402 are wound such that each wire 402 covers a unique portion of the launch conduit 102. However, it will be understood that the wires 402 can be wound as desired. For example, in some instances the wires 402 of a coil 104 can overlap each other. In some embodiments, each wire 402 can be wound such that the turns 404 of the wire 402 are located substantially above, or on top of, previous turns 404 of the wire 402. For example, in the illustrated embodiments, turn 404*a* is substantially above, or on top of, turn 404*b*, which is substantially above turn 404*c*, etc. In certain embodiments, the turns of a wire 402 form concentric spirals around a portion of the launch conduit 102. In some embodiments, all the turns of a single wire 402 are located on the same plane. In certain embodiments, the plane that the wires 402 are located on can be perpendicular, or substantially perpendicular, to the longitudinal axis of the launch conduit 102. In some embodiments, the plane that the wires 402 are located on can be angled with respect to the longitudinal axis of the launch conduit 102. However, it will be understood that the wires of the EM launcher 100 can be wound as desired. For example, in some embodiments, individual wires can be wound around the length (or a portion of the length) of the EM launcher 100. In certain embodiments, the turns of a particular wire are not substantially above, or on top of a previous turn, etc.

The EM launcher 100 can also be used in other applications, such as, transportation, spacecraft launches, space flight, etc. In some embodiments, the armature 114 can be sized so that a vehicle or spacecraft can be the payload package 112. In certain embodiments, the armature 114 can be stationary (e.g., coupled to the ground, building, etc.) and the coils 104 and launch conduit 102 can be coupled to a vehicle. In such embodiments, the force generated by the coils 104 can be used to propel the vehicle rather than the armature. As yet another example, the coils 104 can be coupled to a vehicle and the vehicle can be placed inside of the launch conduit 102.

The foregoing description and claims may refer to elements or features as being "connected" or "coupled" together. As used herein, unless expressly stated otherwise, "connected" means that one element/feature is directly or indirectly connected to another element/feature, and not necessarily mechanically. Likewise, unless expressly stated otherwise, "coupled" means that one element/feature is directly or indirectly coupled to another element/feature, and not necessarily mechanically. Thus, although the various schematics shown in the figures depict example arrangements of elements and components, additional intervening elements, devices, features, or components may be present in an actual embodiment (assuming that the functionality of the described embodiments is not adversely affected).

Although this disclosure has been described in terms of certain embodiments, other embodiments that are apparent to those of ordinary skill in the art, including embodiments that do not provide all of the features and advantages set forth herein, are also within the scope of the disclosure. Moreover, the various embodiments described above can be combined to provide further embodiments. In addition, certain features shown in the context of one embodiment can be incorporated into other embodiments as well. Accordingly, the scope of the disclosure is defined only by reference to the appended claims.

What is claimed is:

1. An electromagnetic launcher, comprising:

a multi-phase linear induction motor drive configured to provide multi-phase, variable frequency alternating current;

a tubular launch conduit; and a plurality of poles comprising a first pole and a second pole;

a plurality of coil groups comprising a first coil group, a second coil group, a third coil group, and a fourth coil group, a plurality of switches comprising:

a first switch electrically coupled to a first phase of the multi-phase linear induction motor drive and the first coil group, a second switch electrically coupled to a second phase of the multi-phase linear induction motor drive and the second coil group, a third switch electrically coupled to the first phase of the multi-phase linear induction motor drive and the third coil group, and a fourth switch electrically coupled to the second phase of the multi-phase linear induction motor drive and the fourth coil group; and a plurality of conductive coils comprising a first conductive coil, a second conductive coil, a third conductive coil, a fourth conductive coil, a fifth conductive coil, a sixth conductive coil, a seventh conductive coil, and an eighth conductive coil, wherein the first pole corresponds to a first portion of the launch conduit and includes:

the first coil group including the first conductive coil and the second conductive coil, and the second coil group including the third conductive coil and the fourth conductive coil, and the second pole corresponds to a second portion of the launch conduit and includes:

the third coil group including the fifth conductive coil and the sixth conductive coil, and the fourth coil group including the seventh conductive coil and the eighth conductive coil, wherein the plurality of conductive coils of at least one coil group of the plurality of coil groups are electrically coupled in parallel or in series and are activated upon activation of a corresponding coil group, wherein each conductive coil of the plurality of coil groups comprises two or more wires wound as a current sheet, each of the two or more wires having a plurality of turns, wherein each of the two or more wires of each of the plurality of conductive coils is wrapped around a unique portion of the launch conduit and each turn of at least one wire of the two or more wires is located substantially above a previous turn of the at least one wire, and wherein the two or more wires are electrically coupled in parallel and are activated upon activation of a corresponding conductive coil.

2. The electromagnetic launcher of claim 1, wherein the multi-phase linear induction motor drive increases a frequency of the alternating current in at least one phase as an armature moves through the tubular launch conduit.

3. An electromagnetic launcher, comprising:

a launch conduit;

a first pole corresponding to a first portion of the launch conduit and including:

a first coil group electrically coupled to a first phase of an alternating current power supply and including a first electrically conductive coil and a second electrically conductive coil coupled to the launch conduit, wherein the first electrically conductive coil and the second electrically conductive coil are electrically coupled in parallel or in series and are activated upon activation of the first coil group, wherein the first electrically conductive coil comprises two or more wires, each having a plurality of turns and each turn of at least one wire of the two or more wires is located substantially above a previous turn of the at least one wire, and wherein the two or more wires are electrically coupled in parallel and are activated upon activation of the first electrically conductive coil, and a second coil group electrically coupled to a second phase of the alternating current power supply and including a third electrically conductive coil and a fourth electrically conductive coil; and a second pole corresponding to a second portion of the launch conduit and including:

a third coil group electrically coupled to the first phase of the alternating current power supply and including a fifth electrically conductive coil and a sixth electrically conductive coil, and a fourth coil group electrically coupled to the second phase of the alternating current power supply and including a seventh electrically conductive coil and a eighth electrically conductive coil.

4. The electromagnetic launcher of claim 3, wherein all turns of the at least one wire are located on a single plane that is perpendicular to a longitudinal axis of the launch conduit.

5. The electromagnetic launcher of claim 3, wherein a frequency of alternating current provided to at least one of the first coil group, the second coil group, the third coil group, or the fourth coil group is increased as an armature moves through the launch conduit.

6. The electromagnetic launcher of claim 3, wherein the first electrically conductive coil and the second electrically conductive coil are separated from each other by a non-magnetic, non-conductive material.

7. The electromagnetic launcher of claim 3, further comprising a conductive armature located within the launch conduit, wherein the conductive armature is electrically isolated from and thermally coupled to a payload package.

8. The electromagnetic launcher of claim 3, further comprising a plurality of switches, comprising:

a first switch electrically coupled to the first phase of the alternating current power supply and the first coil group, a second switch electrically coupled to the second phase of the alternating current power supply and the second coil group, a third switch electrically coupled to the first phase of the alternating current power supply and the third coil group, and a fourth switch electrically coupled to the second phase of the alternating current power supply and the fourth coil group.

9. The electromagnetic launcher of claim 8, wherein each of the first switch, the second switch, the third switch, and the fourth switch comprise an insulated-gate bipolar transistor.

10. The electromagnetic launcher of claim 3, further comprising a conductive armature located within the launch conduit, wherein a length of the conductive armature is at least two poles.

11. A method of ejecting a payload from an electromagnetic launcher, the method comprising:

providing a launch conduit;

providing a first pole corresponding to a first portion of the launch conduit, the first pole including:

a first coil group including a first electrically conductive coil and a second electrically conductive coil coupled to the launch conduit, wherein the first electrically conductive coil and the second electrically conductive coil are electrically coupled in parallel or in series and are activated upon activation of the first coil group, wherein the first electrically conductive coil comprises two or more wires, each having a plurality of turns and each turn of at least one wire of the two or more wires is located substantially above a previous turn of the at least one wire;

wherein the two or more wires are electrically coupled in parallel and are activated upon activation of the first electrically conductive coil, and a second coil group including a third electrically conductive coil and a fourth electrically conductive coil;

providing a second pole corresponding to a second portion of the launch conduit, the second pole including:

a third coil group including a fifth electrically conductive coil and a sixth electrically conductive coil, and a fourth coil group including a seventh electrically conductive coil and a eighth electrically conductive coil;

providing an alternating current power supply electrically coupled to the first coil group, the second coil group, the third coil group, the fourth coil group for providing electrical power to a plurality of electrically conductive coils including the first electrically conductive coil, the second electrically conductive coil, the third electrically conductive coil, the fourth electrically conductive coil, the fifth electrically conductive coil, the sixth electrically conductive coil, the seventh electrically conductive coil, and the eighth electrically conductive coil, wherein the first coil group and the third coil group are electrically coupled to a first phase of the alternating current power supply and the second coil group and the fourth coil group are electrically coupled to a second phase of the alternating current power supply;

providing a conductive armature located within the launch conduit wherein the conductive armature is thermally coupled to and electrically isolated from a payload package including the payload; and accelerating the armature along a longitudinal axis of the launch conduit by supplying alternating current to the plurality of electrically conductive coils.

12. The electromagnetic launcher of claim 1, further comprising a conductive armature located within the launch conduit and having a length that is at least equal to a length of two poles, wherein the conductive armature is electrically isolated from a payload package.

13. The electromagnetic launcher of claim 3, wherein wires proximate an exit of the launch conduit are at least one of thicker than wires distal to the exit or have fewer turns than wires distal to the exit.

14. The electromagnetic launcher of claim 13, wherein a height of electrically conductive coils along a length of the launch conduit is equal.

15. The electromagnetic launcher of claim 3, wherein the first coil group and the second coil group are activated at a same time.

16. The electromagnetic launcher of claim 3, wherein the first pole and the second pole are activated at a same time.

17. The electromagnetic launcher of claim 1, wherein the first pole and the second pole are activated at different times.

18. The electromagnetic launcher of claim 1, wherein:

the plurality of poles further comprises a third pole, the plurality of coil groups further comprises a fifth coil group and a sixth coil group, the plurality of switches further comprises:

a fifth switch electrically coupled to the first phase of the multi-phase linear induction motor drive and the fifth coil group, a sixth switch electrically coupled to the second phase of the multi-phase linear induction motor drive and the sixth coil group, the plurality of conductive coils further comprises a ninth conductive coil, a tenth conductive coil, an eleventh conductive coil and a twelfth conductive coil, and wherein the third pole corresponds to a third portion of the launch conduit and includes:

the fifth coil group including the ninth conductive coil and the tenth conductive coil, and the sixth coil group including the eleventh conductive coil and the twelfth conductive coil.

19. The electromagnetic launcher of claim 1, wherein:

the plurality of coil groups further comprises a fifth coil group and a sixth coil group, the plurality of switches further comprises:

a fifth switch electrically coupled to a third phase of the multi-phase linear induction motor drive and the fifth coil group, a sixth switch electrically coupled to the third phase of the multi-phase linear induction motor drive and the sixth coil group, the plurality of conductive coils further comprises a ninth conductive coil, a tenth conductive coil, an eleventh conductive coil and a twelfth conductive coil, and wherein the first pole further includes the fifth coil group including the ninth conductive coil and the tenth conductive coil, and the second pole further includes the sixth coil group including the eleventh conductive coil and the twelfth conductive coil.

20. The electromagnetic launcher of claim 3, further comprising:

a third pole corresponding to a third portion of a launch conduit and including:

a fifth coil group electrically coupled to the first phase of the alternating current power supply and including a ninth electrically conductive coil and a tenth electrically conductive coil, and a sixth coil group electrically coupled to the second phase of the alternating current power supply and including an eleventh electrically conductive coil and a twelfth electrically conductive coil.

21. The electromagnetic launcher of claim 20, wherein at least two of the first pole, second pole, and third pole are activated during a first time.

22. The electromagnetic launcher of claim 21, wherein at least one of the first pole, second pole, and third pole is not activated during the first time.

23. The electromagnetic launcher of claim 3, wherein:

the first pole further includes a fifth coil group electrically coupled to a third phase of the alternating current power supply and including a ninth electrically conductive coil and a tenth electrically conductive coil, and the second pole further includes a sixth coil group electrically coupled to the third phase of the alternating current power supply and including an eleventh electrically conductive coil and a twelfth electrically conductive coil.

* * * * *